US010770808B2

(12) United States Patent
Youtsey

(10) Patent No.: US 10,770,808 B2
(45) Date of Patent: Sep. 8, 2020

(54) CONNECTOR WITH A LOCKING MECHANISM

(71) Applicant: PCT International, Inc., Mesa, AZ (US)

(72) Inventor: Timothy L. Youtsey, Tempe, AZ (US)

(73) Assignee: PCT International, Inc., Mesa ( * ) Notice: Subject to any disclaimer, the term of this patent is extended or adjusted under 35 U.S.C. 154(b) by 0 days.

(21) Appl. No.: 16/419,721

(22) Filed: May 22, 2019

(65) Prior Publication Data

US 2019/0273332 A1 Sep. 5, 2019

Related U.S. Application Data

(60) Continuation-in-part of application No. 15/898,247, filed on Feb. 16, 2018, now Pat. No. 10,326,219, which is a division of application No. 15/711,170, filed on Sep. 21, 2017, now Pat. No. 10,153,563.

(60) Provisional application No. 62/675,608, filed on May 23, 2018, provisional application No. 62/397,912, filed on Sep. 21, 2016.

(51) Int. Cl.

| | |
|---|---|
| ***H01R 9/05*** | (2006.01) |
| ***H01R 13/639*** | (2006.01) |
| ***H01R 13/641*** | (2006.01) |
| ***H01R 13/627*** | (2006.01) |
| *H01R 24/40* | (2011.01) |
| *H01R 103/00* | (2006.01) |

(52) U.S. Cl.

CPC ..... *H01R 9/0518* (2013.01); *H01R 9/05* (2013.01); *H01R 13/6275* (2013.01); *H01R 13/6277* (2013.01); *H01R 13/639* (2013.01); *H01R 13/6395* (2013.01); *H01R 13/641* (2013.01); *H01R 24/40* (2013.01); *H01R 2103/00* (2013.01)

(58) Field of Classification Search

CPC .... H01R 9/0518; H01R 9/05; H01R 13/6277; H01R 13/639

USPC ..... 439/585

See application file for complete search history.

(56) References Cited

U.S. PATENT DOCUMENTS

| | | | |
|---|---|---|---|
| 3,199,061 | A | 8/1965 | Johnson et al. |
| 4,377,320 | A | 3/1983 | Lathrop et al. |
| 4,990,106 | A | 2/1991 | Szegda |
| 5,393,244 | A | 2/1995 | Szegda |
| 5,466,173 | A | 11/1995 | Down |

(Continued)

FOREIGN PATENT DOCUMENTS

| | | | |
|---|---|---|---|
| DE | 202004000165 | U | 4/2004 |
| WO | 2007055871 | A1 | 5/2007 |

*Primary Examiner* — Alexander Gilman

(74) *Attorney, Agent, or Firm* — Thomas W. Galvani, P.C.; Thomas W. Galvani

(57) ABSTRACT

A coaxial cable termination device includes a barrel having opposed front and rear ends and a circumferential channel. A collet is at the front end of the barrel, and a sleeve is mounted over the barrel for reciprocal movement between a retracted position, in which the sleeve allows expansion and compression of the collet, and an advanced position, in which the sleeve prevents expansion of the collet. A locking mechanism is formed integrally in the sleeve and includes an arm mounted at a living hinge for movement between an unlocked position and a locked position in which a tooth on the arm is disposed within the circumferential channel. A lever is opposite the tooth from the living hinge and releases the arm from the locked position thereof.

20 Claims, 10 Drawing Sheets

(56) References Cited

U.S. PATENT DOCUMENTS 5,498,175 A 3/1996 Yeh et al.
5,501,616 A 3/1996 Holliday
5,564,938 A * 10/1996 Shenkal ..... H01R 13/6397 439/133
5,879,191 A 3/1999 Burris
6,010,289 A 1/2000 Distasio et al.
6,042,422 A 3/2000 Youtsey
6,210,222 B1 * 4/2001 Langham ..... H01R 9/0518 439/578
6,379,183 B1 * 4/2002 Ayres ..... H01R 9/0515 439/578
6,425,782 B1 7/2002 Holland
6,648,683 B2 11/2003 Youtsey
6,712,631 B1 3/2004 Youtsey
6,767,248 B1 7/2004 Hung
6,971,912 B2 * 12/2005 Montena ..... H01R 9/05 439/578
7,144,272 B1 12/2006 Burris et al.
7,288,002 B2 10/2007 Rodrigues et al.
7,364,462 B2 4/2008 Holland
7,377,809 B2 5/2008 Dyck
7,404,373 B2 7/2008 Bailey
7,510,432 B2 3/2009 Entsfellner
7,527,524 B1 5/2009 Coleman et al.
7,753,727 B1 7/2010 Islam et al.
7,934,953 B1 5/2011 Solis
7,976,339 B2 7/2011 Buck et al.
7,997,930 B2 8/2011 Ehret et al.
8,029,316 B2 10/2011 Snyder et al.
8,272,893 B2 * 9/2012 Burris ..... H01R 24/40 439/578
8,287,310 B2 * 10/2012 Burris ..... H01R 24/40 439/578
8,444,433 B2 5/2013 Snyder et al.
8,469,739 B2 6/2013 Rodrigues et al.
8,579,658 B2 11/2013 Youtsey
8,585,439 B2 11/2013 Amidon et al.
8,690,603 B2 4/2014 Bence et al.
8,753,147 B2 6/2014 Montena
8,840,429 B2 9/2014 Thomas et al.
8,882,250 B2 11/2014 Mitsuo
8,894,440 B2 11/2014 Rodrigues et al.
8,915,751 B2 12/2014 Wood
8,944,846 B2 2/2015 Lee
9,039,446 B2 5/2015 Youtsey
9,040,822 B2 * 5/2015 Nieto Lopez ..... H02G 1/00 174/138 F
9,071,019 B2 6/2015 Burris et al.
9,083,113 B2 * 7/2015 Wild ..... H01R 13/623
9,130,281 B2 * 9/2015 Phillips, Jr. ..... H01R 9/0524
9,136,654 B2 * 9/2015 Matzen ..... H01R 9/05
9,147,963 B2 * 9/2015 Balcer ..... H01R 9/0524
9,240,636 B2 * 1/2016 Youtsey ..... H01R 13/622
9,257,780 B2 2/2016 Thomas et al.
9,496,661 B2 11/2016 Purdy et al.
9,768,566 B2 * 9/2017 Wilson ..... H01R 9/0524
10,033,122 B2 7/2018 Burris et al.
10,153,563 B2 * 12/2018 Youtsey ..... H01R 13/6277
2002/0164900 A1 11/2002 Youtsey
2003/0114112 A1 6/2003 Strater et al.
2004/0048514 A1 3/2004 Kodaira
2004/0092165 A1 5/2004 Holland
2005/0148236 A1 7/2005 Montena
2006/0015921 A1 1/2006 Vaughan
2007/0026735 A1 * 2/2007 Pyron ..... B60R 16/0222 439/584
2008/0003873 A1 * 1/2008 Henningsen ..... H01R 13/025 439/578
2009/0053928 A9 2/2009 Entsfellner
2010/0125877 A1 5/2010 Wells et al.
2010/0223651 A1 9/2010 Wang
2010/0233901 A1 * 9/2010 Wild ..... H01R 13/6277 439/578
2010/0233902 A1 * 9/2010 Youtsey ..... H01R 24/40 439/578
2010/0261380 A1 10/2010 Skeels et al.
2010/0261381 A1 * 10/2010 Montena ..... H01R 9/032 439/584
2010/0297875 A1 11/2010 Purdy et al.
2011/0287653 A1 * 11/2011 Youtsey ..... H01R 13/62933 439/345
2012/0021642 A1 1/2012 Zraik
2012/0108098 A1 * 5/2012 Burris ..... H01R 13/639 439/345
2012/0252268 A1 * 10/2012 Zraik ..... H01R 13/622 439/584
2012/0270439 A1 10/2012 Tremba et al.
2012/0289079 A1 * 11/2012 Amidon ..... H01R 13/6592 439/489
2012/0295466 A1 * 11/2012 Youtsey ..... H01R 24/40 439/320
2012/0329311 A1 12/2012 Duval et al.
2013/0130543 A1 * 5/2013 Holland ..... H01R 24/38 439/583
2013/0149896 A1 * 6/2013 Holland ..... H01R 13/11 439/578
2013/0330967 A1 12/2013 Youtsey
2014/0113486 A1 * 4/2014 Wild ..... H01R 4/029 439/578
2014/0342594 A1 11/2014 Montena
2015/0007246 A1 1/2015 Ariesen
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei
2016/0072204 A1 * 3/2016 Edmonds ..... H01R 13/502 439/583
2016/0181742 A1 6/2016 Wilson et al.
2016/0248179 A1 * 8/2016 Burris ..... H01R 43/16
2018/0083374 A1 3/2018 Youtsey
2019/0190170 A1 6/2019 Watkins

* cited by examiner

CONNECTOR WITH A LOCKING MECHANISM

CROSS-REFERENCE TO RELATED APPLICATIONS

This application is a continuation-in-part of and claims the benefit of U.S. patent application Ser. No. 15/898,247, filed Feb. 16, 2018, which is a divisional application and claims the benefit of U.S. patent application Ser. No. 15/711,170, filed Sep. 21, 2017, which claims the benefit of U.S. Provisional Application No. 62/397,912, filed Sep. 21, 2016, all of which are hereby incorporated by reference. This application further claims the benefit of U.S. Provisional Application No. 62/675,608, filed May 23, 2018, which is hereby incorporated by reference.

FIELD OF THE INVENTION

The present invention relates generally to electrical apparatus, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be terminated with cable connectors to be coupled to mating posts of electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. The connectors must maintain electrical connection and signal shielding with the cable despite rotation, tugging, bending, or other movement of the cable and the connector.

Further, the connectors must mitigate the introduction of interference or ingress noise into the connector and signal pathway. Ingress noise causes a variety of problems, including not just reduced signal quality to the home, but large aggregated return path noise issues at the plant. Without properly seating a connector on a female connector or post, ingress noise can leak into the connector. However, it is difficult to know whether a connector is properly seated on a post; without a tool, some ingress noise is nearly guaranteed. An improved connector that mitigates the introduction of ingress noise is needed.

SUMMARY OF THE INVENTION

A coaxial cable termination device includes a barrel having opposed front and rear ends and a circumferential channel therebetween. A collet is at the front end of the barrel, and a sleeve is mounted over the barrel for reciprocal movement between a retracted position, in which the sleeve allows expansion and compression of the collet, and an advanced position, in which the sleeve prevents expansion and urges compression of the collet. A locking mechanism is formed integrally in the sleeve and includes an arm mounted in the sleeve at a living hinge for movement between an unlocked position of the arm and a locked position of the arm in which a tooth on the arm is disposed within the circumferential channel. A lever is opposite the tooth from the living hinge and releases the arm from the locked position thereof.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
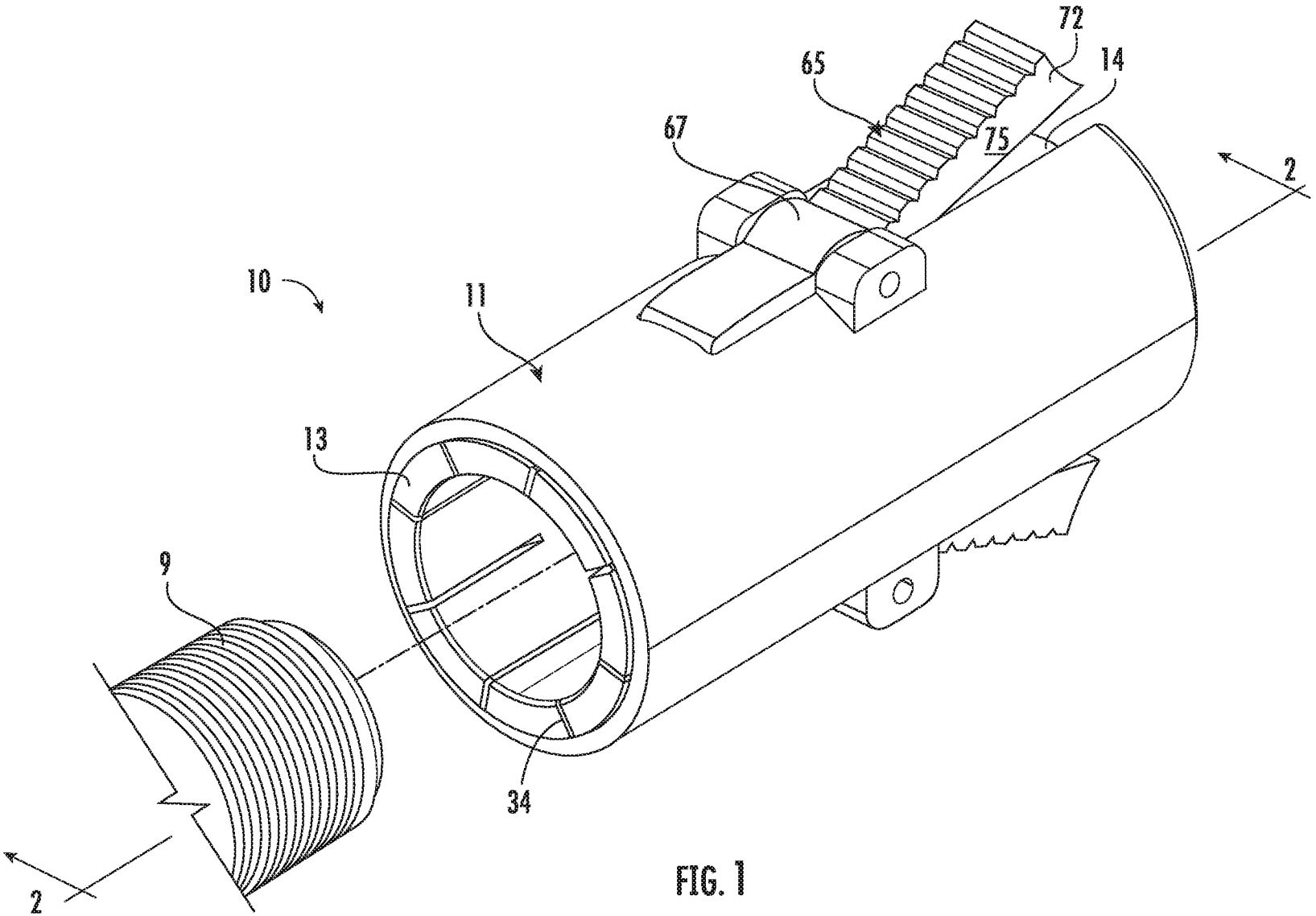
FIG. 1 is a perspective view of a device for terminating a coaxial cable, shown exploded from a mating post of an electronic component, the device including an outer sleeve mounted for reciprocation on a barrel.

Reference now is made to the drawings, in which the same reference characters are used throughout the different figures to designate the same elements. FIG. 1 illustrates an embodiment of a coaxial cable termination device or connector 10 useful for terminating coaxial cables and connecting them to female F-type coaxial mating posts 9 of electronic components. The connector 10 includes a generally cylindrical barrel 12 and an outer sleeve 11 mounted coaxially over the barrel 12 for reciprocation along the barrel 12. Integrally formed in the barrel 12 is a collet 13 and an opposed rear body 14, each of which surrounds a common cylindrical interior 15. As is discussed in detail below, the sleeve 11 reciprocates between retracted and advanced positions over the barrel 12 to allow and prevent expansion of the collet 13, respectively, and to urge the collet 13 into radial compression or deformation and thereby engage the collet 13 securely on a mating post 9.

Figure 2A:
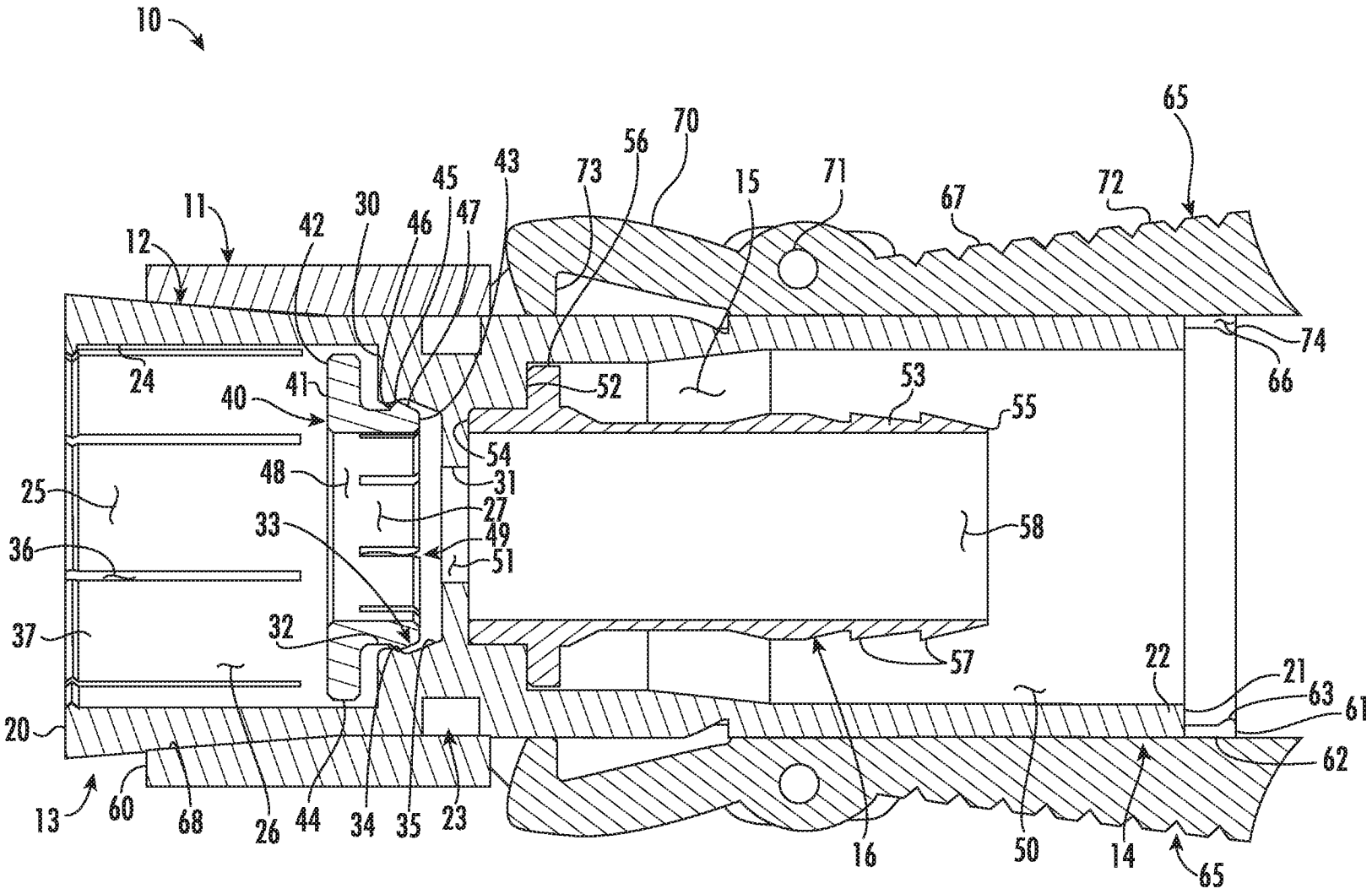
FIGS. 2A and 2B are section views taken along the line 2-2 of FIG. 1, illustrating the sleeve of in retracted and advanced positions, respectively.

FIG. 2A illustrates the connector 10 in section view taken along the line 2-2 in FIG. 1. The barrel 12 includes opposed front and rear ends 20 and 21 and a generally cylindrical sidewall 22 extending therebetween. The collet 13 is at the front end 20, the cylindrical rear body 14 is at the rear end 21, and between, a circumferential annular channel 23 is recessed into the sidewall 22 from the outer surface of the barrel 12. The rear body 14 has generally constant inner and outer diameters, while the collet 13 is slightly conical. The collet 13 has an inner diameter which is generally constant from proximate to the annular channel 23 to the front end 20, but the outer diameter of the collet 13 expands slightly from the annular channel 23 to the front end 20, so that the collet 13 is tapered from front to back.

The collet 13 is sized and shaped to engage with the mating post 9 of FIG. 1. The inner diameter of the collet 13 corresponds in size and shape to the mating post 9. The collet 13 includes an inner surface 24 bounding and defining a forward bore 25 for receiving the mating post 9. The forward bore 25 includes a large open forward section 26 and an opposed, smaller rear section 27. The forward section 26 extends from the front end 20 of the collet 13 to an intermediate wall 30; the inner diameter in the forward section 26 is generally constant. The rear section 27, however, extends from the intermediate wall 30 to an interior wall defined by an annular flange 31 extending inwardly from the inner surface 24.

A radially-directed lip 32 extends inwardly at the intermediate wall 30, which lip 32 projects inward past the inner surface 24 in the rear section 27. The inner diameter of the forward bore 25 in the rear section narrows from just behind the lip 32 to the annular flange 31. Between the lip 32 and the annular flange 31, the barrel 12 defines an annular shoulder 33 extending inwardly into the rear section 27 of the forward bore 25. The annular shoulder 33 has a circumferentially concave inner surface; moving rearward from the lip 32, the outer diameter of the annular shoulder 22 increases to an inflection point, at which it decreases to the base of the annular flange 31, at which point it increases to the annular flange 31. In other words, just behind the lip 32, the annular shoulder 33 includes an annular face 34 directed diagonally rearwardly toward the rear end 21 of the barrel 12. That face opposes an annular face 35 directed diagonally forwardly toward the front end 20 of the barrel 12. These opposing faces 34 and 35 create the annular shoulder 33, a type of annular saddle or seat into which a button 40 is set, the button 40 being useful for maintaining electrical contact and continuity, as will be described.

Still referring to FIG. 2A, the collet 13 includes axial slots 36 formed therein, which allow compression of the collet 13 and the front end 20 of the barrel 12. The slots 34 extend rearward from the front end 20 to proximate to the annular channel 23. There are preferably eight slots 34, as shown in FIG. 1, but one having ordinary skill in the art will readily appreciate that there may be a greater or fewer number of slots 34. The slots define fingers 37 of the collet 13, which fingers 37 are flexible and structured to flex in a radial direction. The inner surface 24 of the collet 13 is preferably smooth, and so the inner surfaces of each of the fingers 37 are smooth. In other embodiments, however, the inner surface 24 at the front end 20 has a single thread or ridge, or a plurality of threads or ridges for engaging with corresponding threads on a mating post 9.

Carried within the collet 13 is a small floating element, referred to herein as a "button 40." The button 40 is a contact means, effective at preventing the ingress of noise and interference into the connector 10 by maintain contact between the end of the mating post 9 and the inner surface 24 of the collet 13. It maintains circumferential contact, as will be described, thereby maintain continuous electrical continuity in the connector 10 and around a center conduct applied to the connector 10.

The button 40 is somewhat disc-shaped and includes a body 41 with a front end 42 and a rear end 43. The button 40 is separate from the barrel 12 and the inner post 16; in other words, it is not formed to or attached to the barrel 12 and the inner post 16. Rather, the button 40 floats near them, carried loosely in the forward bore 25 proximate to the annular flange 31 for contact with the barrel 12. At the front end 42, the button 40 has a annular front flange 44 with an outer diameter just smaller than the inner diameter of the collet 13 in front of the intermediate wall 30, so that the front flange 40 is loosely received within the forward section 26 of the forward bore 25. The flange 41 extends radially outwardly from the cylindrical body 41. Near the rear end 43, a small annular lip, or ridge 45, projects radially outwardly from the body 41. The ridge 45 extends outward a distance less than the front flange 44. The ridge 45 has a forwardly-directed diagonal face 46 and an opposed rearwardly-directed diagonal face 47. Between the front flange 44 and the ridge 45, the body 41 of the button 40 has a reduced outer diameter.

The button 40 has a bore 48 extending therethrough which is coaxial to, aligned with, and in communication with the forward and rear sections 26 and 27 of the bore forward 25. Axial slots 49 formed into the body 41 and extending from the rear end 43 to the base of the front flange 44 allow the rear end 43 of the body 41 to flex and compress into the bore 48 radially.

With continuing reference to FIG. 2A, the annular flange 31 separates the interior 15 between the forward bore 25 and a rearward bore 50. The annular flange 31 directly radially opposes the annular channel 23. A hole 51, encircled by the annular flange, is coaxial to the forward and rearward bores 25 and 50 and in open communication with both. The rearward bore 50 is substantially cylindrical. The rearward bore 50 corresponds to the size and shape to a coaxial cable, and the hole 51 corresponds in size and shape to the center conductor and surrounding dielectric of said coaxial cable. The rearward bore 50 is encircled by the rear body 14. The rear body 14 extends rearwardly. The rear body 14 is generally cylindrical and extends from an inner wall 52 to the rear end 21 of the barrel 12. The rear body 14 bounds the rearward bore 50. An inner post 16 is carried coaxially within the rear body 14. The inner post 16 includes a relatively thin sidewall 53 extending from a front end 54 to a back end 55 and having a forward flange 56 proximate to the front end 54, and rear annular barbs 57 proximate to the back end 55. The sidewall 53 of the inner post 16 bounds a bore 58 extending axially entirely through the inner post 16. The forward flange 56, when the inner post 16 is installed in the rear body 14, is flush in contact against the inner wall 52 and extends entirely diametrically within the rear body 14; the inner post 16 is preferably press fit into the rear body 14.

Figure 2B:
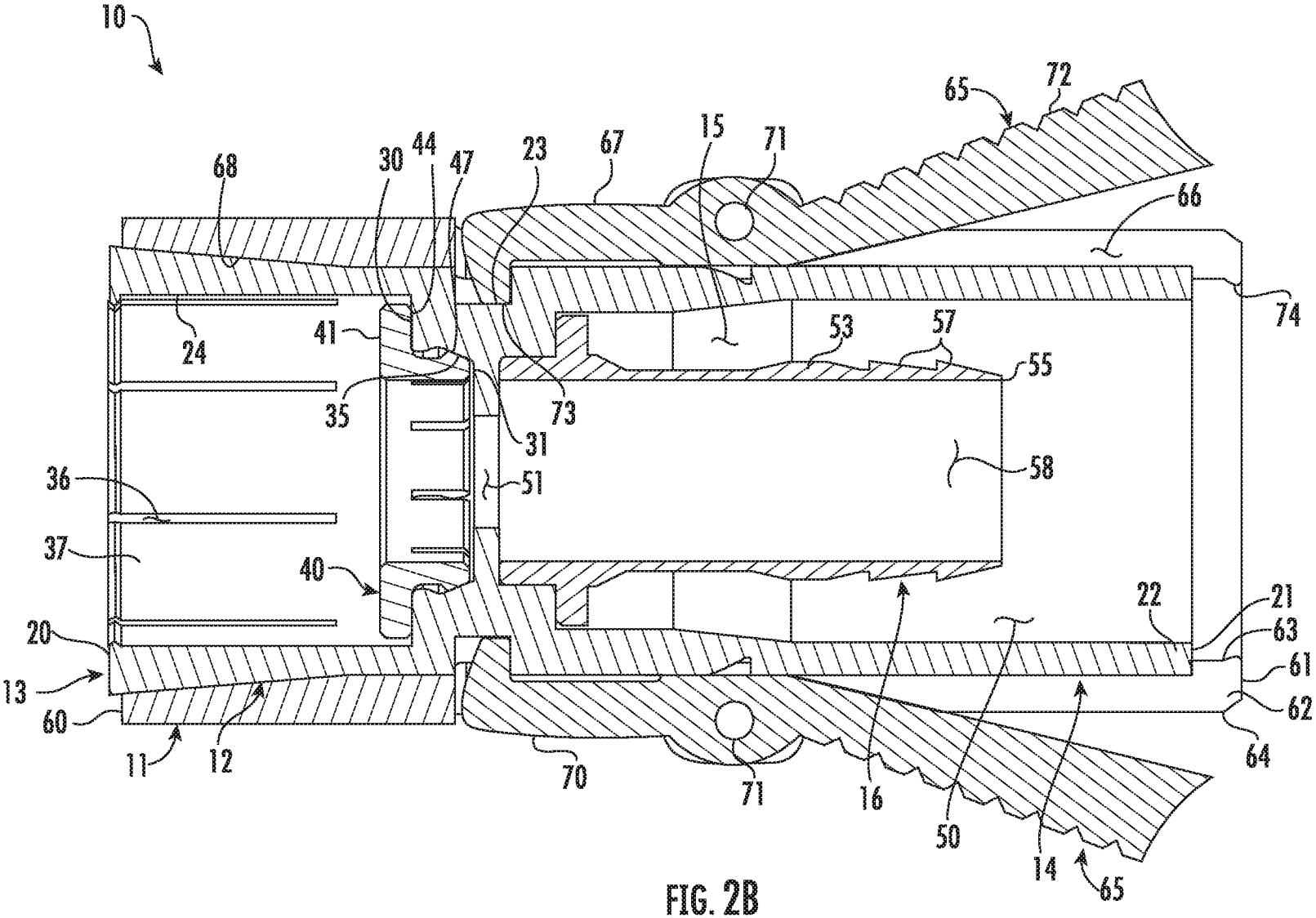

The collet 13 is joined in mechanical communication with the rear body 14 as a single, unitary body. In the embodiment shown in the drawings, the collet 13 is formed integrally and monolithically to the rear body 14, preferably from a common piece of material. The sleeve 11 is carried outside of the barrel 12, and is mounted for reciprocal movement thereon. In FIG. 2A, the sleeve 11 is shown in a retracted position, while FIG. 2B shows the sleeve 11 in an advanced position. The sleeve 11 is useful to force the collet 13 into radial compression. As is explained in greater detail below, when the sleeve 11 is slid forward over the barrel 12, the collet 13 radially compresses, preferably on a mating post 9. Thus, in the retracted position of the sleeve 11, the sleeve 11 allows either radial expansion or radial compression of the collet 13, but in the advanced position of the sleeve 11, the sleeve 11 prevents radial expansion of the collet 13 and urges compression thereof.

The sleeve 11 includes a front 60, an opposed rear 61, and a cylindrical sidewall 62 extending therebetween. The sidewall 62 includes an inner surface 63 and an opposed outer surface 64. The inner surface 63 defines the cylindrical space in which the barrel 12 is received. The inner surface 63 is generally cylindrical, straight, and smooth. However, at the front 60 of the sleeve 11, the inner surface 63 angles slightly radially outwardly, such that there is a chamfer 68 at the front 60 of the sleeve 11. This chamfer 68 provides room for the conical collet 13.

Two locking mechanisms 65 are carried in the sleeve 11 and are useful for locking the sleeve 11 with respect to the barrel 12. The locking mechanisms 65 are identical but for their diametrically opposed locations on the sleeve 11, and as such, only one of the locking mechanisms 65 will be referred to, with the understanding that the description applies equally to both. Further, two locking mechanisms 65 are shown in the drawings, but one having ordinary skill in the art will readily appreciate that other numbers of locking mechanisms 65, such as one, three, four, etc., may be useful depending on the sizes of the connector 10 and cable as well as the desired strength and security of the engagement of the connector 10 on the mating post 9.

The locking mechanism 65 is carried in an axial slot 66 within the sleeve 11, and includes a rocking arm 67 having a jaw 70 projecting forwardly from a pivot 71 and a lever 72 projecting backward from the pivot 71. The locking mechanism 65 is arrangeable between a locked condition, in which the sleeve 11 is prevented from moving out of the advanced position, and an unlocked condition, in which the sleeve 11 is allowed to reciprocate between the advanced and retracted positions. The pivot 71 is a pivot pin carried in the sleeve 11. The rocking arm includes an inwardly-directed tooth 73 at its forward end, oriented normal to the arm 67. The rocking arm 67 moves from an unlocked position (corresponding to the unlocked condition of the locking mechanism 65), shown in FIG. 2A, to a locked position (corresponding to the locked condition of the locking mechanism 65), shown in FIG. 2B. It rocks in this movement, such that the arm 67 and the lever 72 rock about the pivot 71 to move the tooth 73 into and out of the annular channel 23. The rocking arm 67 is biased toward the locked position, such as by torsional springs on the pivot 71. Opposed from the jaw 70, the lever 72 extends outward and is useful to move, or reset, the rocking arm 67 from the locked position to the unlocked position. The lever 72 may be depressed radially inward to move, or rock, the rocking arm 67 radially outward from the locked position to the unlocked position.

At the rear 61 of the sleeve 11, an inwardly-extending lip 74 is formed and defines a mouth at the back of the connector 10. The mouth receives a coaxial cable applied to the connector 10. The lip 74 acts as a stop against the rear end 21 of the barrel 12 to prevent forward movement of the sleeve 11 on the barrel 12 beyond the advanced position of the sleeve 11.

Figure 3A:
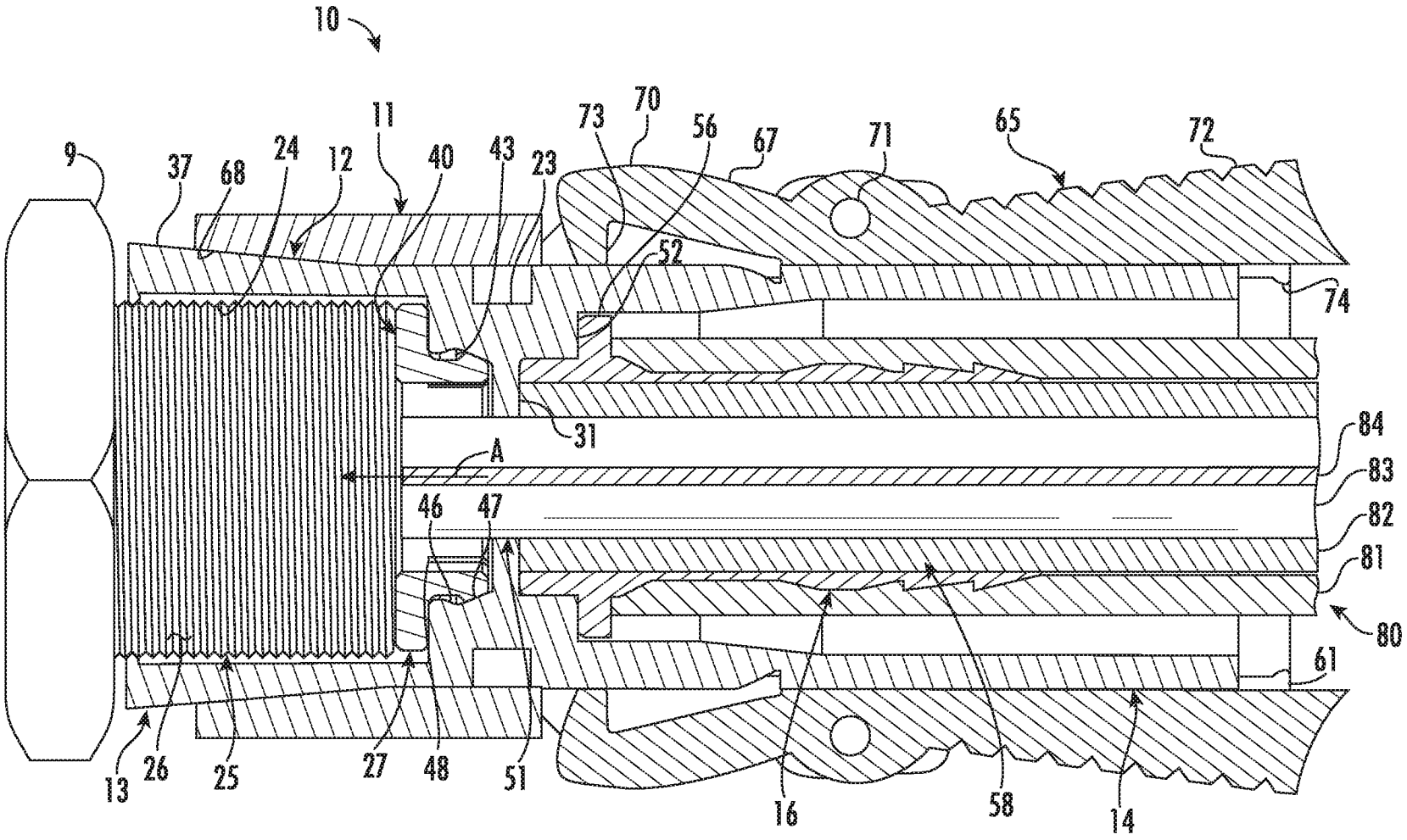
FIGS. 3A and 3B are section views taken along the line 2-2 of FIG. 1, illustrating a cable applied to the device, the device applied on a mating post, and the sleeve in the retracted and advanced positions thereof, respectively.

In operation, the connector 10 is useful as a push-on locking connector that can be quickly and easily applied and locked onto a mating post 9, and then securely left in place. To apply the connector 10 to a mating post 9, the connector 10 is first preferably applied to a cable 80. A cable 80, such as a coaxial cable 80, is conventionally prepared, such as by stripping back the jacket 81 and foil and braid 82. The cable 80 is then applied into the connector 10. As shown in FIG. 3A, the cable 80 passes through the mouth defined by the lip 61, and the dielectric 83 and center conductor 84 of the cable 80 pass into the bore 58 inside the inner post 16, while the jacket 81, foil, and braid pass over the inner post 16, between the inner post 16 and the rear body 14. The cable 80 is advanced until the jacket 81 and foil and braid 82 encounter the forward flange 56 and the inner wall 52. The center conductor 84, which is typically prepared to be longer than the dielectric 83, jacket 81, and foil and braid 82, extends through the hole 51, through the bore 48 of the button 40, and into the forward bore 25 of the collet 13. The center conductor thus terminates within the collet 13.

Once so properly prepared, the connector 10 is ready for application to the mating post 9. FIG. 3A shows the connector 10 applied to the mating post 9. The connector 10, with the cable 80 extending out the rear 61, is taken up, such as by hand, and aligned and registered with the mating post 9. With the sleeve 11 in the unlocked position thereof, as shown in FIG. 2A, the connector 10 is advanced along a forward axial direction illustrated by line A of FIG. 3A. While the sleeve 11 is in the unlocked position thereof, and is retracted on the barrel 12, the collet 13 is free to expand and contract or compress radially. The collet 13 is applied over the mating post 9, causing the collet 13 to expand: the slots 34 expand such that the fingers 37 splay radially outward slightly, and the collet 13 passes onto and over the mating post 9. The connector 10 is advanced until the mating post 9 is firmly seated within the forward section 26 of the forward bore 25. The fingers 37 are slightly expanded.

With the mating post 9 seated in the forward bore 25, the front of the mating post 9 is in contact against the front flange 44 of the button 40. The button 40 "floats," such that before a mating post 9 is applied to the collet 13, the button 40 may freely move in an axial direction with the ridge 45 within the rear section 27 of the forward bore 25. When it does, the rear end 43 of the button 40 expands and contracts radially to maintain contact with the annular shoulder 33 of the barrel 12: the slots 49 in the back of the button 40 are slightly compressed and thus the rear end 43 is biased radially outwardly such that they contact and ride against the annular shoulder 33 as the button 40 floats along the axial direction.

The button 40 is biased forward, toward the front end 20 of the barrel 12. The outward bias in the rear end 43 of the button 40 urges the ridge 45 to move into the inflection point between the faces 46 and 47. This urges the button 40 forward along the annular shoulder 33. As such, the button 40 contacts the front of the mating post 9 before the mating post is fully applied to the connector 10. This thus creates electrical continuity between the mating post 9 and the connector 10 even before the mating post 9 is fully captured.

When the front of the mating post 9 is in contact against the front flange 44, and the connector 10 continues to be advanced and applied onto the mating post 9, the mating post 9 pushes the button 40 rearwardly into the rear section 27 of the forward bore 25. When the button 40 is so pushed, the ridge 45 is pressed against the annular shoulder, and the rear end 43 of the button 40 is radially compressed.

Partial engagement of the mating post 9 with the collet 13 thus provides electrical continuity between the two, and seated engagement of the mating post 9 with the collet 13 ensures electrical continuity between the mating post 9 and the button 40 and between the button 40 and the annular shoulder 43. The button 40 is limited in axial movement and forms an annular electrical continuity with the inner surface 24 surrounding the center conductor. This engagement, shown in FIG. 3A, prevents the introduction of outside interference and signals into the connector 10, thereby preserving much of the quality of the RF signal transmitted through the connector 10.

Figure 3B:
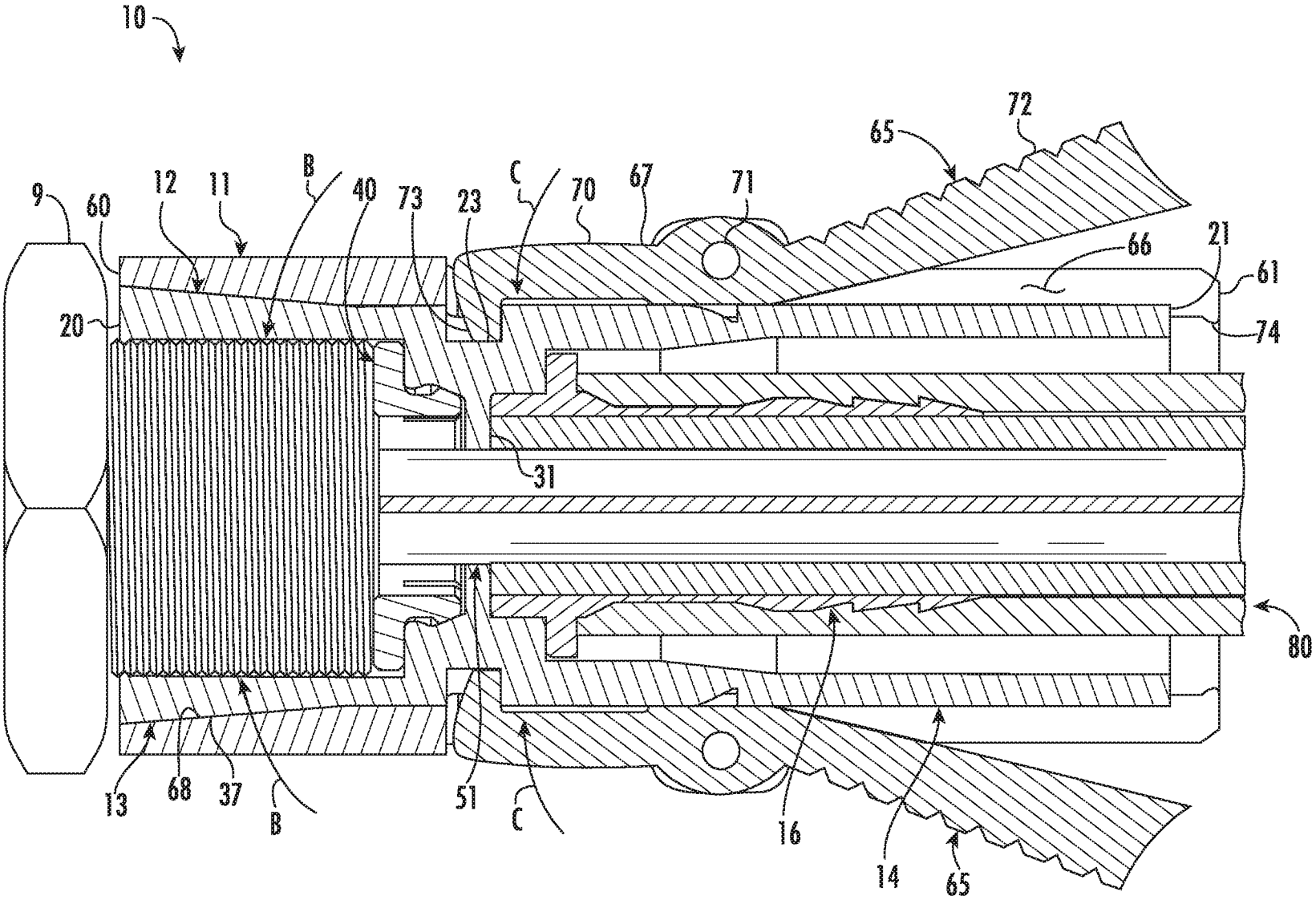

To ensure the security of the engagement of the connector 10 on the mating post 9, the sleeve 11 is moved forward, again along line A, to the advanced position as shown in FIG. 3B. In the advanced position of the sleeve 11, the front 60 of the sleeve 11 is advanced to proximate the front end 20 of the barrel 12, squeezing the barrel 12 inwardly along the lines B in FIG. 2B. The sleeve 11 constricts the collet 13 in a radially inward direction, with the chamfer 68 compressing the collet 13 and causing the collet 13 and the fingers 37 of the collet 13 to deform and compress in a radial inward direction. The fingers 37 deform onto the mating post 9 and bind against the mating post 9, increasing the hold of the connector 10 on the mating post 9. The sleeve 11 prevents expansion of the collet 13, such that the collet 13 cannot release its grip on the mating post 9. In this state, the connector 10 cannot be pulled accidentally off the mating post 9.

In response to the sleeve 11 moving into the advanced position thereof, the locking mechanism 65 automatically locks the sleeve 11 to prevent rearward movement. As the sleeve 11 moves forward, the tooth 73 moves forward until it is disposed over the annular channel 23 formed into the outer surface of the barrel 12.

The arm 67 is biased into the locked position thereof. The jaw 70, biased radially inward, pivots toward and into the annular channel 23, along the arrowed line C in FIG. 3B, in response to the sleeve 11 moving into the advanced position. When the sleeve 11 moves to the advanced position, the front of the slot 66 becomes aligned with the annular channel 23, and the rocking arm 67 pivots so that the tooth 73 moves into the annular channel 23. The tooth 73, biased inwardly by the sprung rocking arm 67, is thus caught in and catches the annular channel 23; the sleeve 11 is prevented from moving axially forward or rearward by the interaction of the tooth 73 in the annular channel 23. This corresponds to a locked position of the connector 10: with the tooth 73 engaged in the annular channel 23, the sleeve 11 is prevented from axial movement rearwardly over the barrel 12, the front 60 of the sleeve cannot be moved back off the collet 13, and the collet 13 is prevented from moving out of compression moving off the mating post 9.

To confirm that the connector 10 is in the locked condition thereof, a visual indicator is exposed. The visual indicator is preferably concealed when the locking mechanism 65 is in the unlocked condition and is exposed when the locking mechanism 65 is in the locked condition, so that a user can quickly determine the locked status of the connector 10. Turning back to FIG. 1, the connector 10 is in the locked position (for clarity, the connector 10 is not shown installed on a mating post 9); the rocking arm 67 is pivoted, the tooth 73 is down into the annular channel 23, and the lever 72 opposed from the rocking arm 67 is up. The lever 72 has a side face 75, which is a visual indicator or may carry a visual indicator. When the lever 72 is up, the side face 75, or a portion thereof, is exposed which is not exposed when the lever 72 is down. The side face 75 preferably carries a color, such as green, which contrasts with the color of the exterior surface of the sleeve 11, which may be black or silver. As such, when the side face 75 (or portion thereof) is exposed and the user can see the color of the side face 75, the connector 10 immediately conveys to the user that the lever 72 is up, the jaw 70 is down, the tooth 73 is in the annular channel 23, and the connector 10 is thus in the locked position thereof. As such, the user can quickly determine whether the connector 10 is locked onto a mating post 9 or loose. In other embodiments, the side face 75 carries another indicator, such as a symbol or word, that allows the user to determine whether the connector 10 is locked.

When the user decides to remove the connector 10 from the mating post 9, the user merely takes up the connector 10, such as by hand, and depresses the lever 72 on each of the locking mechanisms 65, until the lever 72 pivots into the slot 66 and the jaw 70 pivots outward, thereby releasing the tooth 73 from the annular channel 23. The side face 72 of the lever is concealed in the slot 66 so that the color on the side face 75 of the lever 72 is hidden. When the tooth 73 is so released from the annular channel 23, the sleeve 11 can be slid rearward on the barrel 12 into the unlocked position thereof, thereby releasing the collet 13 from compression, and allowing the fingers 37 to spring away from the mating post 9. In this state, the connector 10 can now be removed from the mating post 9.

Figure 4:
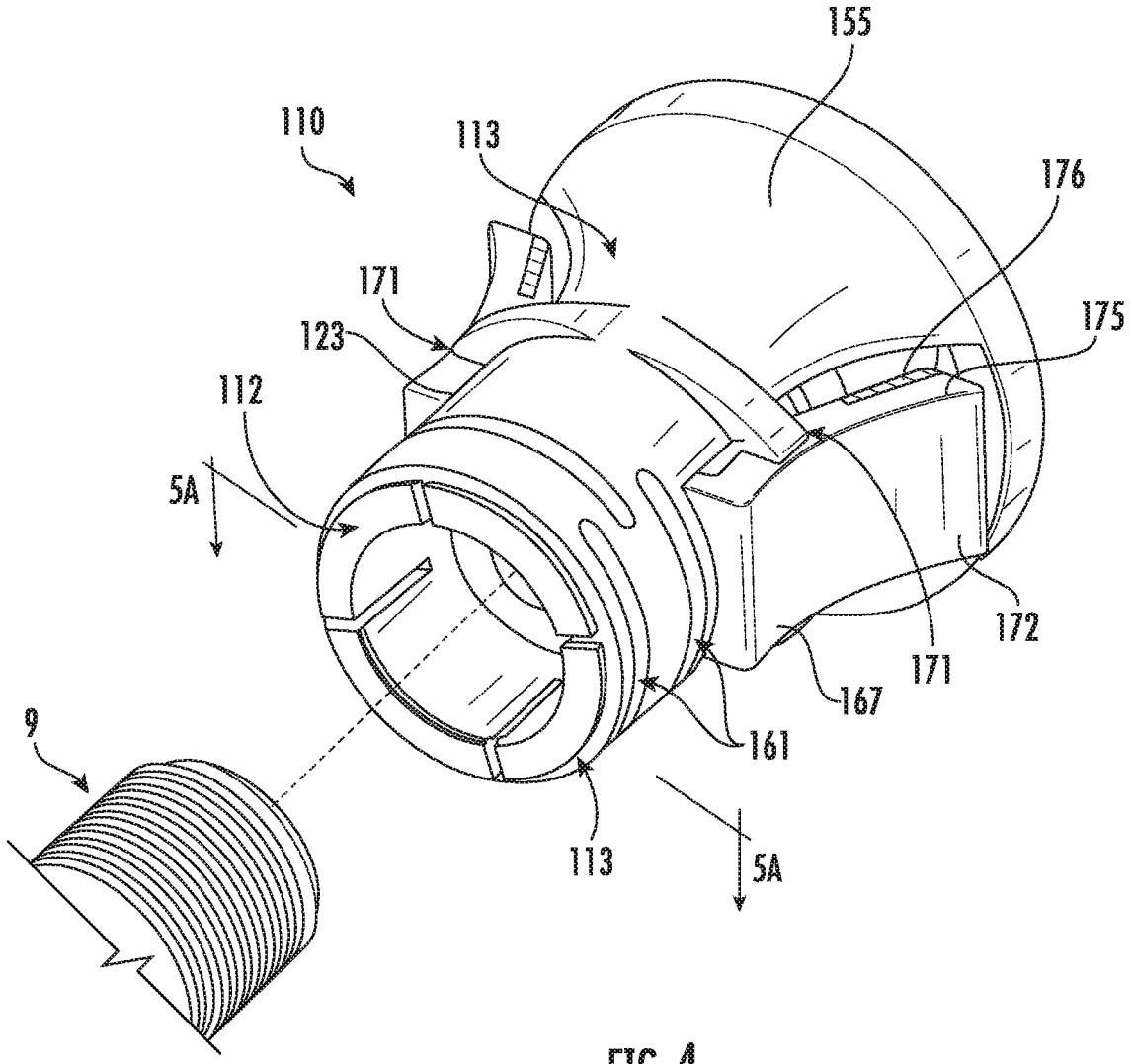
FIG. 4 is a perspective view of a device for terminating a coaxial cable, shown exploded from a mating post of an electronic component, the device including an outer sleeve mounted for rotation on a barrel.

FIG. 4 illustrates a coaxial cable termination device or connector 110 useful for terminating coaxial cables and connecting them to female F-type coaxial mating posts 9 of electronic components. The connector 110 includes a generally bell-shaped outer sleeve 111 mounted coaxially over a generally cylindrical barrel 112 for reciprocation along the barrel 112. Integrally formed in the barrel 112 is a collet 113 and an opposed rear body 114, each of which surrounds a common cylindrical interior 115. As is discussed in detail below, the sleeve 111 reciprocates between retracted and advanced positions over the barrel 112 to allow and prevent expansion of the collet 113, respectively, and to urge the collet 113 into radial compression or deformation and thereby engage the collet 113 securely on a mating post 9.

Figure 5A:
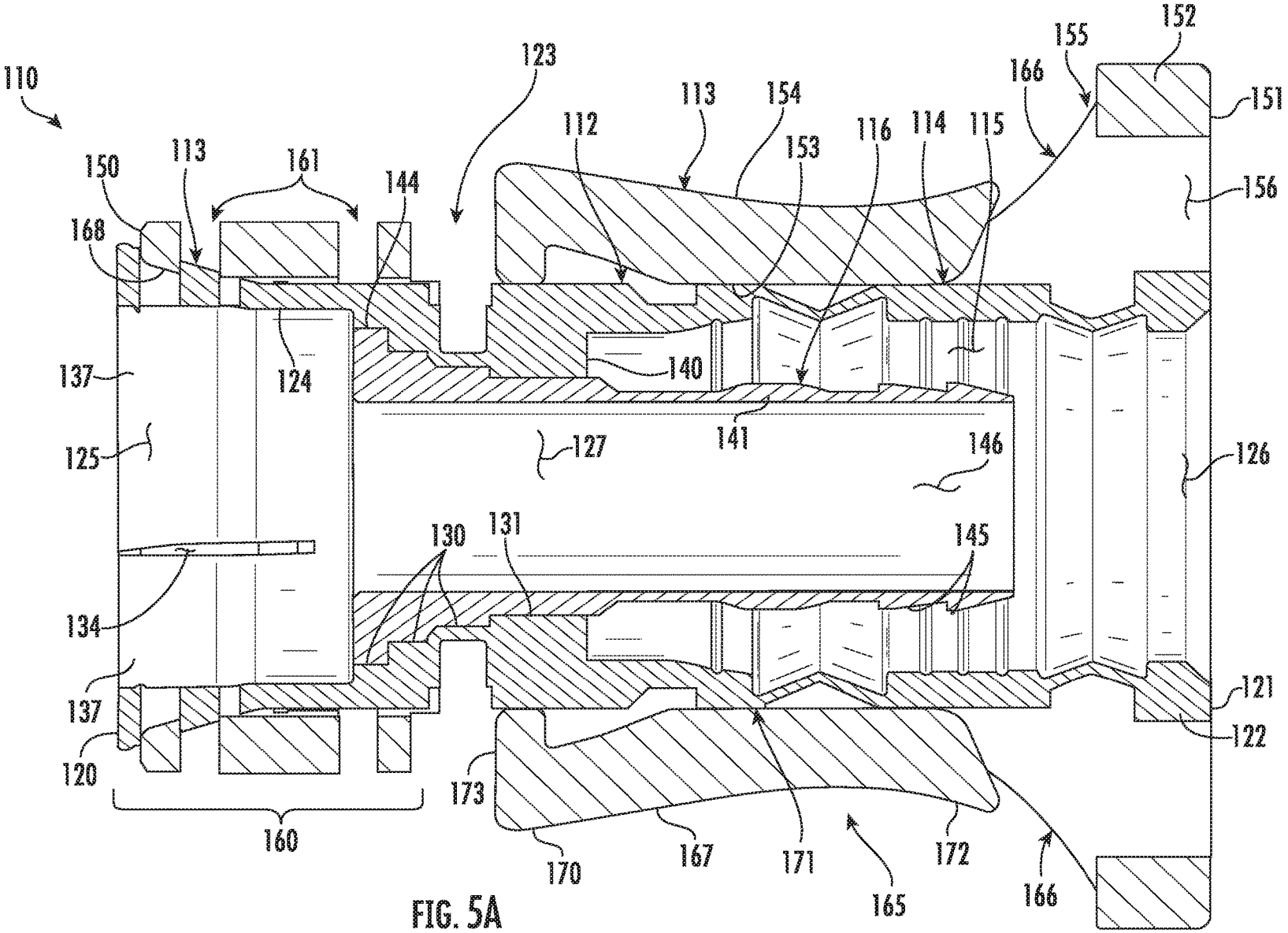
FIGS. 5A and 5B are section views taken along the line 5A-5A of FIG. 4, illustrating the sleeve in retracted and advanced positions, respectively.

FIG. 5A illustrates the connector 110 in section view taken along the line 5A-5A in FIG. 4. The barrel 112 includes opposed front and rear ends 120 and 121 and a generally cylindrical sidewall 122 extending therebetween. The collet 113 is at the front end 120, the cylindrical rear body 114 is at the rear end 121, and between, a circumferential annular channel 123 is recessed into the sidewall 122 from the outer surface of the barrel 112. The rear body 114 has generally constant inner and outer diameters, while the collet 113 is slightly conical. The collet 113 has an inner diameter which is generally constant from proximate to the annular channel 123 to the front end 120, but the outer diameter of the collet 113 expands slightly from the annular channel 123 to the front end 120, so that the collet 113 is tapered from front to back.

The collet 113 is sized and shaped to engage with the mating post 9 of FIG. 4. The inner diameter of the collet 113 corresponds in size and shape to the mating post 9. The collet 113 includes an inner surface 124 bounding and defining a forward bore 125 for receiving the mating post 9. Proximate the rear end of the collet 113, the forward bore 125 is constricted by a series of stepped-inner diameter reductions, just in front of the annular channel 123. The inner diameter of the forward bore 125 thus narrows, defining several annular shoulders 130 which terminate eventually at an inward annular flange 131.

Still referring to FIG. 5A, the collet 113 includes axial slots 134 formed therein, which allow compression of the collet 113 and the front end 120 of the barrel 112. The slots 134 extend rearward from the front end 120 toward the annular channel 123. There are preferably four slots 134, as shown in FIG. 4, but one having ordinary skill in the art will readily appreciate that there may be a greater or fewer number of slots 134. The slots 134 define fingers 137 of the collet 113, which fingers 137 are flexible and structured to flex in a radial direction. The inner surface 124 of the collet 113 is preferably smooth, and so the inner surfaces of each of the fingers 137 are smooth as well. In other embodiments, however, the inner surface 124 at the front end 120 has a single thread or ridge, or a plurality of threads or ridges for engaging with corresponding threads on a mating post 9.

With continuing reference to FIG. 5A, the annular flange 131 separates the interior 115 between the forward bore 125 and a rearward bore 126. The annular flange 131 is just behind the annular channel 123. A hole 127, encircled by the annular flange 131, is coaxial to the forward and rearward bores 125 and 126 and in open communication with both. The rearward bore 126 is substantially cylindrical. The rearward bore 126 corresponds to the size and shape to a coaxial cable, and the hole 127 corresponds in size and shape to the center conductor and surrounding dielectric of said coaxial cable. The rearward bore 126 is encircled by the rear body 114.

The rear body 114 extends rearwardly from the collet 113. The rear body 114 is generally cylindrical and extends from an inner endwall 140 to the rear end 121 of the barrel 112. The rear body 114 bounds the rearward bore 126. An inner post 116 is carried coaxially within the rear body 114. The inner post 116 includes a relatively thin sidewall 141 extending from a front end 142 to a back end 143 and having forward flanges 144 proximate to the front end 142, and rear annular barbs 145 proximate to the back end 143. The sidewall 141 of the inner post 116 bounds a bore 146 extending axially entirely through the inner post 116. The forward flange 144, when the inner post 116 is installed in the rear body 114, is flush in contact against the shoulders 130 and extends entirely diametrically within the back of the collet 113, just in front of the circumferential channel 123; the inner post 116 is preferably press fit into the shoulders 130 in this area.

Figure 5B:
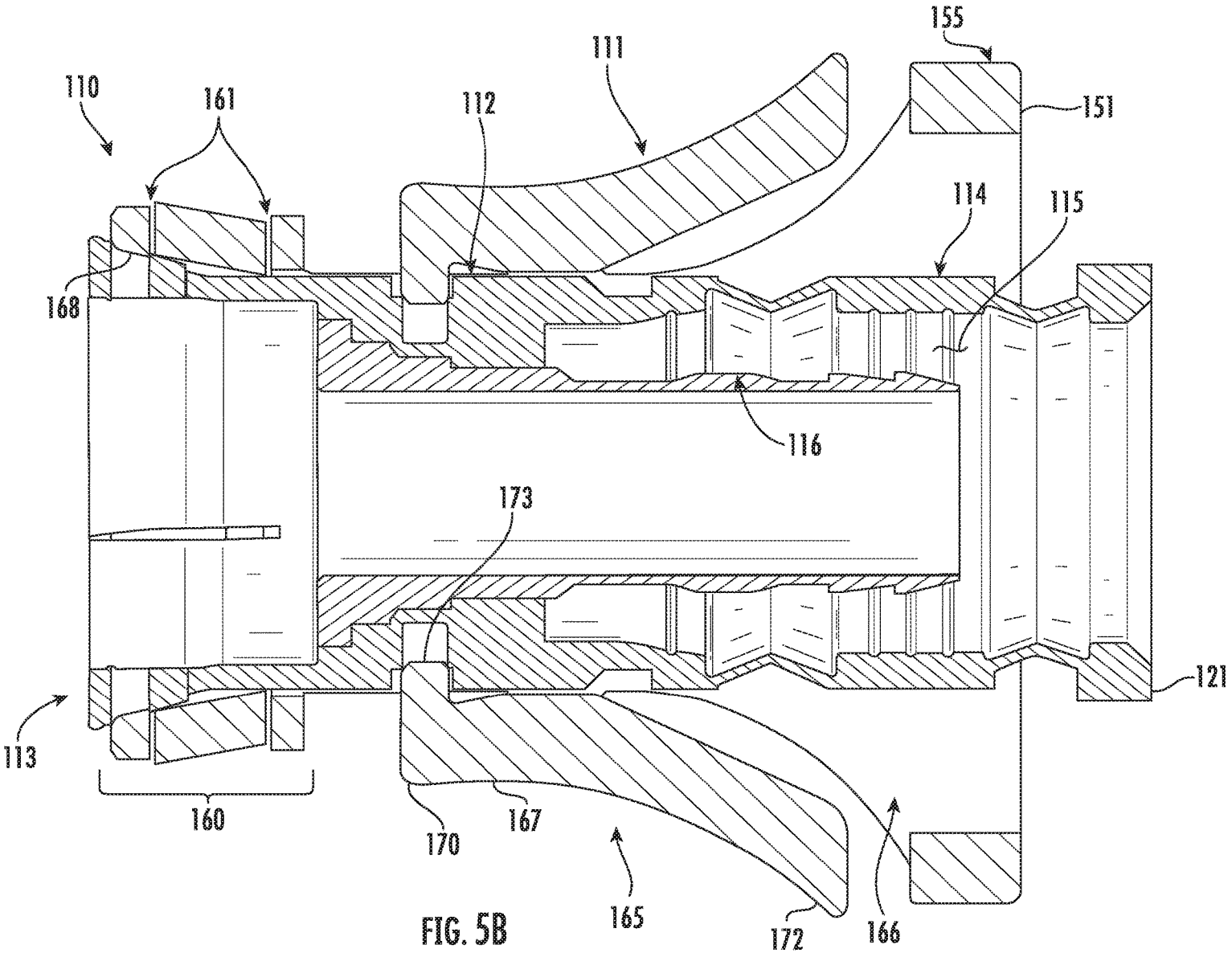

The collet 113 is joined in mechanical communication with the rear body 114 as a single, unitary body. Indeed, in the embodiment shown in FIGS. 4-6B, the collet 113 is formed integrally and monolithically to the rear body 114, preferably from a common piece of material. The sleeve 111 is carried outside of the barrel 112, and is mounted for reciprocal movement thereon. In FIG. 5A, the sleeve 111 is shown in a retracted position, while FIG. 5B shows the sleeve 111 in an advanced position. The sleeve 111 is useful to force the collet 113 into radial compression and hold it there. As is explained in greater detail below, when the sleeve 111 is slid forward over the barrel 112, the collet 113 radially compresses, preferably on a mating post 9. Thus, in the retracted position of the sleeve 111, the sleeve 111 allows either radial expansion or radial compression of the collet 113, but in the advanced position of the sleeve 111, the sleeve 111 prevents radial expansion of the collet 113 and urges compression thereof.

The sleeve 111 includes a front end 150, an opposed rear end 151, and a cylindrical sidewall 152 extending therebetween. The sidewall 152 includes an inner surface 153 and an opposed outer surface 154. The inner surface 153 defines the cylindrical space in which the barrel 112 is received. The inner surface 153 is generally cylindrical, straight, and smooth. There are some deviations, however.

A compression nose 160 is formed at the front end 150 of the sleeve 111. The compression nose 160 includes a plurality of circumferential slots 161 formed therein. The slots 161 are formed at the outer surface 154 and extend radially inwardly entirely through the sleeve 111 to the inner surface 153. The slots 161 do not, however, extend entirely around the outer surface 154, but rather only around a portion of the outer surface 154 or a portion of the circumference, so that they do not completely sever the sleeve 111. These slots 161 define discontinuities in the inner surface 153 of the sleeve 111. Moreover, the slots 161 are compression zones for the compression nose 160; when the sleeve 111 slides forward, the slots 161 decrease in axial width, thereby allowing the sleeve 111 to shorten in axial length. This further creates an axially-compressive bias in the sleeve 111. Further still, at the compression nose 160, the inner surface 153 angles slightly radially outwardly, such that there is a chamfer 168 at the compression nose 160. This chamfer 168 provides room for the conical collet 113.

At the opposed rear end 151 of the sleeve 111, the sleeve 111 includes a bell 155. The outer surface 154 of the sleeve 111 expands arcuately and radially outward to an increasingly larger diameter, resulting in a smooth, curved bell-shaped portion of the rear end 151. The bell 155 is somewhat hollow, defining a large toroidal opening 156 between the outer surface of the barrel 112 and the inner surface 153 of the sleeve 111.

Two locking mechanisms 165 are carried in the sleeve 111 and are useful for locking the sleeve 111 with respect to the barrel 112. The locking mechanisms 165 are identical but for their diametrically opposed locations on the sleeve 111, and as such, only one of the locking mechanisms 165 will be referred to, with the understanding that the description applies equally to both. Further, two locking mechanisms 165 are shown in the drawings, but one having ordinary skill in the art will readily appreciate that other numbers of locking mechanisms 165, such as one, three, four, etc., may be useful depending on the sizes of the connector 110 and cable as well as the desired strength and security of the engagement of the connector 110 on the mating post 9.

The locking mechanism 165 is carried in a wide axial slot 166 within the sleeve 111; it includes a rocking arm 167 having a jaw 170 projecting forwardly from a living hinge 171 and a lever 172 projecting backward from the living hinge 171. The locking mechanism 165 is arrangeable between a locked condition, in which the sleeve 111 is prevented from moving out of the advanced position, and an unlocked condition, in which the sleeve 111 is allowed to reciprocate between the advanced and retracted positions.

The locking mechanism 165 is formed integrally and monolithically in the sleeve 111, mounted thereto at the living hinge 171. The living hinge 171 is a pivot point which is integrally and monolithically formed between the sidewall 152 of the sleeve 111 and the locking mechanism 165 itself; it flexes and bends when the locking mechanism 165 rocks. The arm 167 includes an inwardly-directed tooth 173 at its forward end, oriented normal to the arm 167. The arm 167 moves from an unlocked position (corresponding to the unlocked condition of the locking mechanism 165), shown in FIG. 5A, to a locked position (corresponding to the locked condition of the locking mechanism 165), shown in FIG. 5B. It rocks in this movement, such that the arm 167 and the lever 172 rock about the living hinge 171 to move the tooth 173 into and out of the annular channel 123. The arm 167 is biased toward the locked position by the spring force of the living hinge 171. Opposed from the jaw 170, the lever 172 extends outward and is useful to move, or reset, the arm 167 from the locked position to the unlocked position. The lever 172 may be depressed radially inward to move, or rock, the arm 167 radially outward from the locked position to the unlocked position.

The lever 172 itself moves into and out of the sleeve 111 during movement of the locking mechanism 165. As can be seen in FIG. 5A, in the unlocked condition of the locking mechanism 165, the lever 172 is recessed within the bell 155 at the rear end 151 of the sleeve 111. The outer surface 154 along the lever 172 is radially inward from the outer surface 154 at the rear end 151, and the inner surface 153 along the lever 172 is flush in contact against the outer surface of the barrel 112. The lever 172 is directed generally axially toward the rear end 151. In contrast, as can be seen in FIG. 5B, in the locked condition of the locking mechanism 165, the lever 172 is raised outside of the bell 155 at the rear end 151 of the sleeve 111. Both the inner and outer surfaces 153 and 154 along the lever 172 correspond roughly to the curvature of the bell 155 but are both radially outside of the outer surface 154 along the bell 155, raised up off the outer surface of the barrel 112. Moreover, the lever 172 is directed generally radially and axially toward the outer edge of the bell 155 proximate the rear end 151.

Figure 6A:
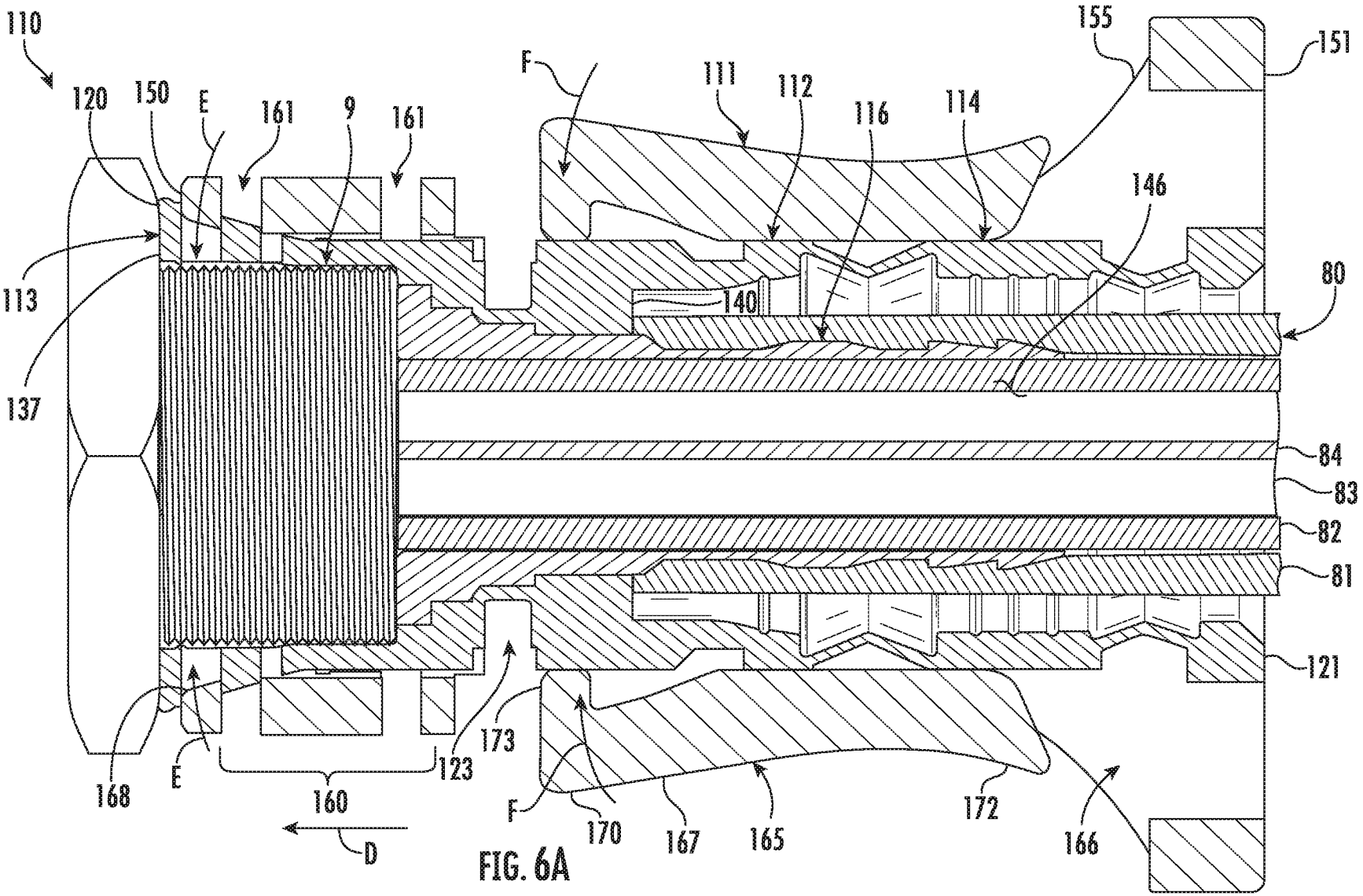
FIGS. 6A and 6B are section views taken along the line 5A-5A of FIG. 4, illustrating a cable applied to the device, the device applied on a mating post, and the sleeve in the retracted and advanced positions thereof, respectively.

In operation, the connector 110 is useful as a push-on locking connector that can be quickly and easily applied and locked onto a mating post 9, and then securely left in place. To apply the connector 110 to a mating post 9, the connector 110 is first preferably applied to a cable 80. A cable 80, such as a coaxial cable 80, is conventionally prepared, such as by stripping back the jacket 81 and foil and braid 82. The cable 80 is then applied into the connector 110. As shown in FIG. 6A, the cable 80 passes through the mouth at the rear end 121 of the barrel 112, and the dielectric 83 and center conductor 84 of the cable 80 pass into the bore 146 inside the inner post 116, while the jacket 81, foil, and braid pass over the inner post 116, between the inner post 116 and the rear body 114. The cable 80 is advanced until the jacket 81 and foil and braid 82 encounter the endwall 140. The center conductor 84, which is typically prepared to be longer than the dielectric 83, jacket 81, and foil and braid 82, extends through the hole 127 and into the forward bore 125 of the collet 113. The center conductor 84 thus terminates within the collet 113.

Once so properly prepared, the connector 110 is ready for application to the mating post 9. FIG. 6A shows the connector 110 applied to the mating post 9. The connector 110, with the cable 80 extending out the rear end 121, is taken up, such as by hand, and aligned and registered with the mating post 9. With the sleeve 111 in the unlocked position thereof, as shown in FIG. 5A, the connector 110 is advanced along a forward axial direction illustrated by line D of FIG. 6A. While the sleeve 111 is in the unlocked position thereof, and is retracted on the barrel 112, the collet 113 is free to expand and contract or compress radially. The collet 113 is applied over the mating post 9, causing the collet 113 to expand: the slots 134 expand such that the fingers 137 splay radially outward slightly, and the collet 113 passes onto and over the mating post 9. The connector 110 is advanced until the mating post 9 is firmly seated within the forward bore 125. The fingers 137 are slightly expanded.

With the mating post 9 loosely seated in the forward bore 125, the front of the mating post 9 is in contact against the front-most forward flange 144 in the connector 10 and in contact with the front end of the cable 80 and its constituent elements. This creates electrical continuity between the mating post 9 and the connector 110. Loose engagement of the mating post 9 with the collet 113 thus provides electrical continuity between the two, and seated engagement of the mating post 9 with the collet 113 ensures electrical continuity between the mating post 9 and the collet 113. This engagement, shown in FIG. 6A, prevents the introduction of outside interference and signals into the connector 110, thereby preserving much of the quality of the RF signal transmitted through the connector 110.

Figure 6B:
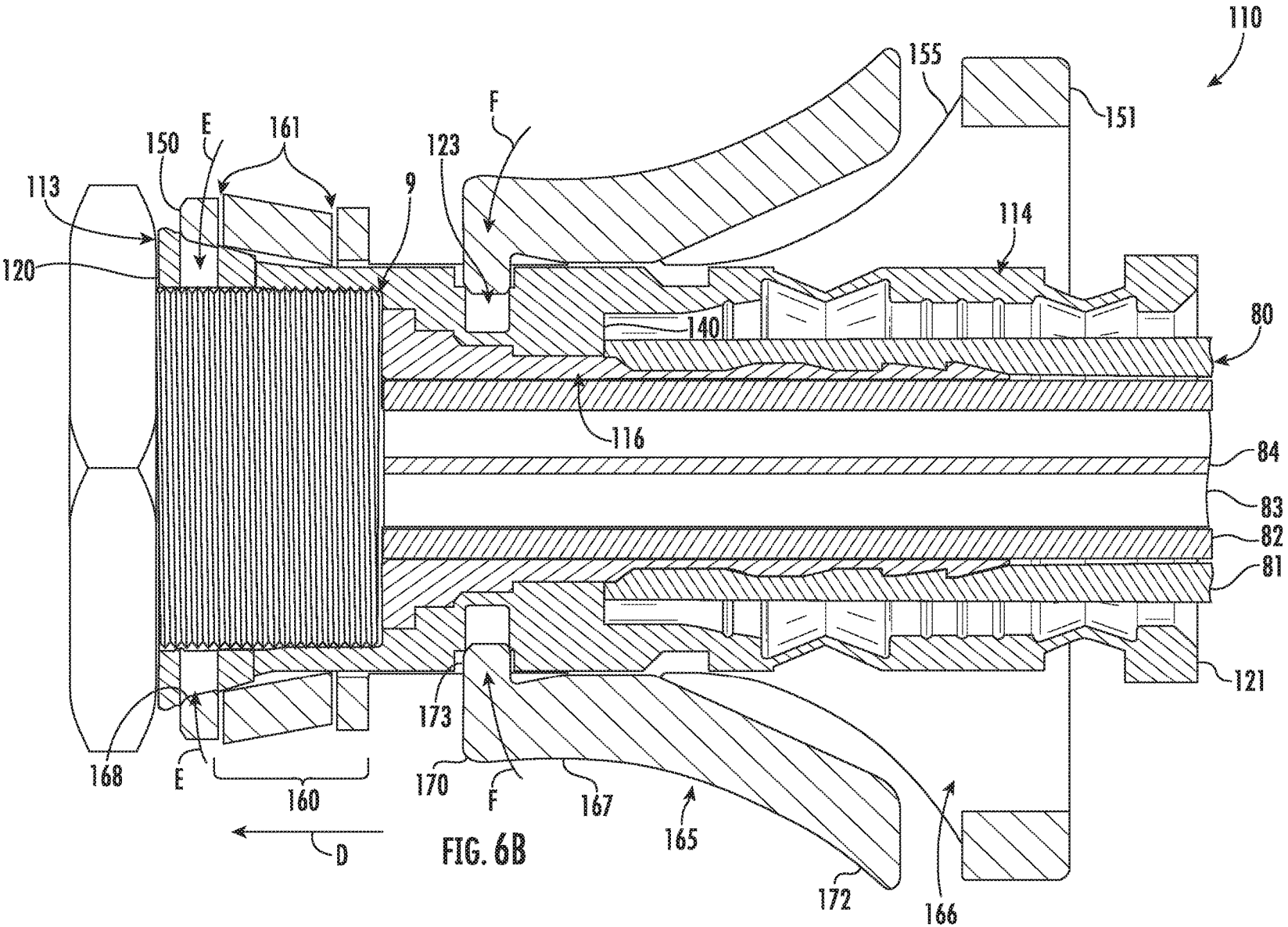

To ensure the security of the engagement of the connector 110 on the mating post 9, the sleeve 111 is moved forward, again along line D, to the advanced position as shown in FIG. 6B. In the advanced position of the sleeve 111, the front end 150 of the sleeve 111 is advanced to proximate the front end 120 of the barrel 112, squeezing the barrel 112 inwardly along the lines E in FIG. 6A. The compression nose 160 of the sleeve 111 constricts the collet 113 in a radially inward direction, with the chamfer 168 compressing the collet 113 and causing the collet 113 and the fingers 137 of the collet 113 to deform and compress in a radial inward direction. The fingers 137 deform onto the mating post 9 and bind against the mating post 9, increasing the hold of the connector 110 on the mating post 9. The sleeve 111 prevents expansion of the collet 113, such that the collet 113 cannot release its grip on the mating post 9. In this state, the connector 110 cannot be pulled accidentally off the mating post 9.

In response to the sleeve 111 moving into the advanced position thereof, the locking mechanism 165 automatically locks the sleeve 111 to prevent rearward movement. As the sleeve 111 moves forward, the tooth 173 moves forward until it is disposed over the annular channel 123 formed into the outer surface of the barrel 112.

The arm 167 is biased into the locked position thereof, primarily by the spring constant of the living hinge 171. The jaw 170, biased radially inward, pivots toward and into the annular channel 123, along the arrowed line F in FIG. 6B, in response to the sleeve 111 moving into the advanced position. When the sleeve 111 moves to the advanced position, the front of the locking mechanism 165 becomes aligned with the annular channel 123, and the arm 167 pivots so that the tooth 173 moves into the annular channel 123. The tooth 173, biased inwardly by the sprung arm 167, is thus caught in and catches the annular channel 123; the sleeve 111 is prevented from moving axially forward or rearward by the interaction of the tooth 173 in the annular channel 123. This corresponds to a locked position of the connector 110: with the tooth 173 engaged in the annular channel 123, the sleeve 111 is prevented from axial movement rearwardly over the barrel 112, the front end 150 of the sleeve cannot be moved back off the collet 113, and the collet 113 is prevented from moving out of compression moving off the mating post 9.

Moreover, the compression nose 160 helps ensure the security of the locked position. When the sleeve 111 is moved forward, a forward force is applied along the line D to axially compress the compression nose 160. As described above, the slots 161 axially compress, and as a result, the compression nose 160 axially compresses. However, the compression nose 160, constructed integrally from the same material of the sleeve 111, is resilient. Axial compression of it applies a spring potential to the compression nose 160, so that it has a spring bias in a direction opposite the line D to return to its original position and arrangement, that of the unlocked condition. The compression nose 160 therefore pushes back on the sleeve 111 in a direction opposite the line D. This causes the tooth 173 to push axially against the annular channel 173, thereby increasing the tightness of that engagement and securing it. With an axial force applied from the tooth 173 to the channel 123, normal to the potential direction of movement of the tooth 173 out of the channel 123, friction helps prevent inadvertent unlocking of the tooth 173.

To confirm that the connector 110 is in the locked condition thereof, a visual indicator is exposed. The visual indicator is preferably concealed when the locking mechanism 165 is in the unlocked condition and is exposed when the locking mechanism 165 is in the locked condition, so that a user can quickly determine the locked status of the connector 110. Turning back to FIG. 4, the locking mechanism 165 is in the locked condition (for clarity, the connector 110 is not shown installed on a mating post 9); the arm 167 is pivoted, the tooth 173 is down into the annular channel 123, and the lever 172 opposed from the arm 167 is up. The lever 172 has a side face 175, on which is a visual indicator 176. When the lever 172 is up, the side face 175, or a portion thereof, is exposed which is not exposed when the lever 172 is down and recessed within the bell 155. The visual indicator 176 is preferably a color, such as green, which contrasts with the color of the exterior surface of the sleeve 111, which may be black or silver. As such, when the side face 175 (or portion thereof) is exposed and the user can see the color of the visual indicator 176, the connector 110 immediately conveys to the user that the lever 172 is up, the jaw 170 is down, the tooth 173 is in the annular channel 123, and the connector 110 is thus in the locked position thereof. As such, the user can quickly determine whether the connector 110 is locked onto a mating post 9 or loose. In other embodiments, the side face 75 carries another visual indicator, such as a symbol or word, that allows the user to determine whether the connector 110 is locked.

When the user decides to remove the connector 110 from the mating post 9, the user merely takes up the connector 110, such as by hand, and depresses the lever 172 on each of the locking mechanisms 165, until the lever 172 pivots into the slot 166 and the jaw 170 pivots outward, thereby releasing the tooth 173 from the annular channel 123. The visual indicator 176 on the lever is concealed in the slot 166 so that the color on the side face 175 of the lever 172 is hidden. When the tooth 173 is so released from the annular channel 123, the sleeve 111 can be slid rearward on the barrel 112 into the unlocked position thereof, thereby releasing the collet 113 from compression, and allowing the fingers 137 to spring away from the mating post 9. In this state, the connector 110 can now be removed from the mating post 9.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A coaxial cable termination device comprising:

a barrel including opposed front and rear ends and a circumferential channel therebetween;

a collet at the front end of the barrel;

a sleeve mounted over the barrel for reciprocal movement between a retracted position, in which the sleeve allows expansion and compression of the collet, and an advanced position, in which the sleeve prevents expansion and urges compression of the collet; and a locking mechanism formed integrally in the sleeve, the locking mechanism including an arm mounted in the sleeve at a living hinge for movement between an unlocked position of the arm and a locked position of the arm in which a tooth on the arm is disposed within the circumferential channel, and a lever opposite the tooth from the living hinge to release the arm from the locked position thereof.

2. The termination device of claim 1, wherein movement of the sleeve over the barrel from the retracted position to the advanced position causes the locking mechanism to lock the sleeve in the advanced position.

3. The coaxial cable termination device of claim 1, wherein the locking mechanism includes a visual indicator which is concealed when the sleeve is in the retracted position and which is exposed when the sleeve is in the advanced position.

4. The termination device of claim 1, wherein the locking mechanism is arrangeable between a locked condition, in which the sleeve is prevented from moving out of the advanced position, and an unlocked condition, in which the sleeve is allowed to reciprocate between the advanced and retracted positions.

5. The termination device of claim 1, wherein in the unlocked position of the arm, the tooth is out of the circumferential channel.

6. The termination device of claim 1, wherein:

the tooth is aligned normal to the arm;

the lever carries a visual indicator; and the arm rocks about the pivot to move the tooth into and out of the circumferential channel, wherein when the tooth is within the circumferential channel, the visual indicator is exposed, and when the tooth is out of the circumferential channel, the visual indicator is concealed.

7. The termination device of claim 1, wherein the arm is biased toward the locked position.

8. A coaxial cable termination device comprising:

a barrel including opposed front and rear ends and a circumferential channel therebetween;

a collet at the front end of the barrel;

a sleeve mounted over the barrel for reciprocal movement between a retracted position, in which the sleeve allows expansion and compression of the collet, and an advanced position, in which the sleeve prevents expansion and urges compression of the collet; and a locking mechanism formed integrally in the sleeve, the locking mechanism including an arm mounted in the sleeve at a living hinge for movement between an unlocked position of the arm and a locked position of the arm in which a tooth on the arm is disposed within the circumferential channel, and a lever opposite the tooth from the living hinge to release the arm from the locked position thereof;

wherein movement of the sleeve over the barrel from the retracted position to the advanced position causes the locking mechanism to lock the sleeve in the advanced position.

9. The termination device of claim 8, wherein the locking mechanism includes a visual indicator which is concealed when the sleeve is in the retracted position and which is exposed when the sleeve is in the advanced position.

10. The termination device of claim 8, wherein the locking mechanism is arrangeable between a locked condition, in which the sleeve is prevented from moving out of the advanced position, and an unlocked condition, in which the sleeve is allowed to reciprocate between the advanced and retracted positions.

11. The termination device of claim 8, wherein in the unlocked position of the arm, the tooth is out of the circumferential channel.

12. The termination device of claim 8, wherein:

the tooth is aligned normal to the arm;

the lever carries a visual indicator; and the arm rocks about the pivot to move the tooth into and out of the circumferential channel, wherein when the tooth is within the circumferential channel, the visual indicator is exposed, and when the tooth is out of the circumferential channel, the visual indicator is concealed.

13. The termination device of claim 8, wherein the arm is biased toward the locked position.

14. The coaxial cable termination device of claim 8, further comprising a bell at the rear end of the barrel, wherein in the unlocked condition of the locking mechanism, the lever is recessed within the bell at the rear end of the barrel, and in the locked condition of the locking mechanism, the lever is raised outside of the bell at the rear end of the barrel.

15. A coaxial cable termination device comprising:

a barrel including opposed front and rear ends and a circumferential channel therebetween;

a collet at the front end of the barrel;

a bell at the rear end of the barrel;

a sleeve mounted over the barrel for reciprocal movement between a retracted position, in which the sleeve allows expansion and compression of the collet, and an advanced position, in which the sleeve prevents expansion and urges compression of the collet; and a locking mechanism formed integrally to the sleeve at a living hinge and including an arm, a tooth, and a lever opposite the tooth from the living hinge, wherein the locking mechanism moves between unlocked condition in which the sleeve is allowed to reciprocate between the advanced and retracted positions and a locked condition in which the sleeve is prevented from moving out of the advanced position.

16. The coaxial cable termination device of claim 15, wherein movement of the sleeve over the barrel from the retracted position to the advanced position causes the locking mechanism to lock the sleeve in the advanced position.

17. The coaxial cable termination device of claim 15, wherein the locking mechanism includes a visual indicator which is concealed when the sleeve is in the retracted position and which is exposed when the sleeve is in the advanced position.

18. The coaxial cable termination device of claim 15, wherein in the unlocked condition of the locking mechanism, the tooth is out of the circumferential channel.

19. The coaxial cable termination device of claim 15, wherein the locking mechanism is biased toward the locked condition.

20. The coaxial cable termination device of claim 15, wherein:

in the unlocked condition of the locking mechanism, the lever is recessed within the bell at the rear end of the barrel; and in the locked condition of the locking mechanism, the lever is raised outside of the bell at the rear end of the barrel.

* * * * *